US011464285B2

(12) United States Patent
Jenkins et al.

(10) Patent No.: US 11,464,285 B2
(45) Date of Patent: Oct. 11, 2022

(54) SHOE HAVING A SOLE MEMBER AND SPRING ELEMENT

(71) Applicant: Cole Haan LLC, New York, NY (US)

(72) Inventors: Kyle Jenkins, Greenland, NH (US); Kristafer Couture, Greenland, NH (US)

(73) Assignee: COLE HAAN LLC, Greenland, NH (US)

( * ) Notice: Subject to any disclaimer, the term of this patent is extended or adjusted under 35 U.S.C. 154(b) by 479 days.

(21) Appl. No.: 15/997,651

(22) Filed: Jun. 4, 2018

(65) Prior Publication Data

US 2019/0365035 A1 Dec. 5, 2019

(51) Int. Cl.

| | |
|---|---|
| ***A43B 13/18*** | (2006.01) |
| ***A43B 13/12*** | (2006.01) |
| ***A43B 13/04*** | (2006.01) |

(52) U.S. Cl.

CPC ..... *A43B 13/187* (2013.01); *A43B 13/04* (2013.01); *A43B 13/122* (2013.01)

(58) Field of Classification Search

CPC ..... A43B 13/187; A43B 13/122; A43B 13/04; A43B 7/24; A43B 13/12; A43B 13/18; A43B 13/188; A43B 13/00; A43B 13/14; A43B 13/181

USPC ..... 36/103

See application file for complete search history.

(56) References Cited

U.S. PATENT DOCUMENTS

| | | | | |
|---|---|---|---|---|
| 9,210,967 | B2 * | 12/2015 | Gerber | A43B 5/02 |
| 2013/0067774 | A1 * | 3/2013 | Auger | A43B 13/141 36/103 |
| 2014/0115925 | A1 * | 5/2014 | Hurd | A43B 13/122 36/103 |
| 2014/0325876 | A1 * | 11/2014 | Dodge | A43B 7/1445 36/103 |
| 2015/0257487 | A1 * | 9/2015 | Ruiz | A43B 23/025 36/103 |

* cited by examiner

*Primary Examiner* — Khoa D Huynh
*Assistant Examiner* — Uyen T Nguyen
(74) *Attorney, Agent, or Firm* — Thompson Coburn LLP

(57) ABSTRACT

A shoe includes an upper and a sole coupled to the upper. The sole includes a sole member and a spring element. The sole member has a footbed surface, a bottom surface opposite the footbed surface, a heel side surface, a toe side surface, a medial side surface, and a lateral side surface. The spring element is in contact with the toe side surface of the sole member, the lateral side surface of the sole member, the heel side surface of the sole member, and a portion of the medial side surface of the sole member. The spring element is adapted and configured to support the sole member by resisting deflection due to one or more of lateral deformation of the sole member and longitudinal deformation of the sole member.

17 Claims, 7 Drawing Sheets

SHOE HAVING A SOLE MEMBER AND SPRING ELEMENT

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND

Field

This disclosure pertains to shoes having a spring element.

SUMMARY

One aspect of the disclosure pertains to a shoe having an upper and a sole coupled to the upper. The sole extends longitudinally from a sole heel end to a sole toe end and extends transversely from a sole lateral edge to a sole medial edge. The sole includes a heel end region, a heel region, a midfoot region, a ball region, a toe region, a toe end region, a lateral edge region, and a medial edge region. The heel end region extends longitudinally from the sole heel end to the heel region. The heel region extends longitudinally from the sole heel end region to the midfoot region. The midfoot region extends longitudinally from the heel region to the ball region, and the midfoot region has a lateral midfoot region and a medial midfoot region. The lateral midfoot region extends transversely from the lateral edge to the medial midfoot region, and the medial midfoot region extends transversely from the medial edge to the lateral midfoot region. The ball region of the sole extends longitudinally from the midfoot region to the toe region. The toe region extends longitudinally from the ball region to the toe end region. The toe end region extends longitudinally from the toe region to the sole toe end. The lateral edge region extends from the lateral edge toward the medial edge. The medial edge region extends from the medial edge toward the lateral edge. The sole comprising a sole member and a spring element. The sole member has a footbed surface, a bottom surface opposite the footbed surface, a heel side surface, a toe side surface, a medial side surface, and a lateral side surface. The sole member extends longitudinally from the heel end region to the toe end region. The sole member extends longitudinally from the lateral edge region to the medial edge region. The spring element is in contact with the toe side surface of the sole member, the lateral side surface of the sole member, the heel side surface of the sole member, and a portion of the medial side surface of the sole member. The spring element is adapted and configured to support the sole member by resisting deflection due to one or more of lateral deformation of the sole member and longitudinal deformation of the sole member.

Another aspect of the disclosure pertains to a shoe having an upper and a sole coupled to the upper. The sole extends longitudinally from a sole heel end to a sole toe end and extends transversely from a sole lateral edge to a sole medial edge. The sole includes al, heel end region, a heel region, a midfoot region, a ball region, a toe region, a toe end region, a lateral edge region, and a medial edge region. The heel end region extends longitudinally from the sole heel end to the heel region. The heel region extends longitudinally from the sole heel, end region to the midfoot region. The midfoot region extends longitudinally from the heel region to the ball region, and the midfoot region has a lateral midfoot region and a medial midfoot region. The lateral midfoot region extends transversely from the lateral edge to the medial midfoot region, and the medial midfoot region extends transversely from the medial edge to the lateral, midfoot region. The ball region of the sole extends longitudinally from the midfoot region to the toe region. The toe region extends longitudinally from the ball region to the toe end region. The toe end region extends longitudinally from the toe region to the sole toe end. The lateral edge region extends from the lateral edge toward the medial edge. The medial edge region extends from the medial edge toward the lateral edge. The sole includes a sole member and a spring element. The sole member has a footbed surface, a bottom surface opposite the footbed surface, a heel side surface, a toe side surface, a medial side surface, and a lateral side surface. The sole member extends longitudinally from the heel end region to the toe end region. The sole member extends longitudinally from the lateral edge region, to the medial edge region. The spring element has a ground contacting portion and a side wall portion. The side wall portion extends upwardly from the ground contacting portion. The side wall portion of the spring element overlaps at least a portion of the sole member toe side surface, a portion of the sole member lateral side surface, a portion of the sole member heel side surface, and a portion of the sole member medial side surface. The side wall portion of the spring element does not overlap at least a portion of the sole member medial side surface in the medial midfoot region. The ground contacting, portion of the spring element overlaps at least a portion of the bottom surface of the sole member.

Further features and advantages of the present disclosure, as well as the operation of the embodiments described herein, are described in detail below with reference to the accompanying drawings.

Figure 1:
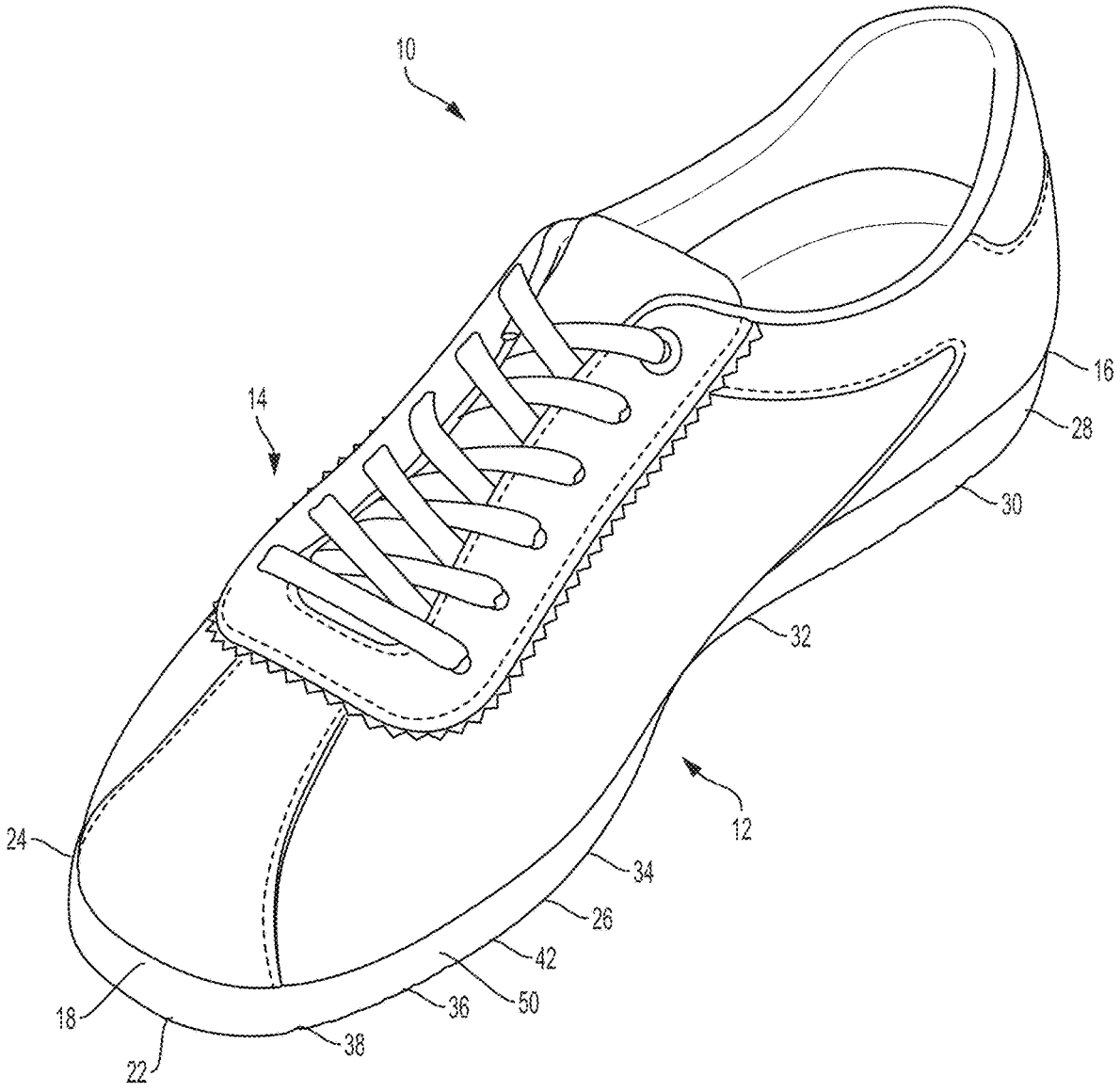
FIG. 1 is a perspective view of a shoe having a sole member and a spring element.
Figure 2:
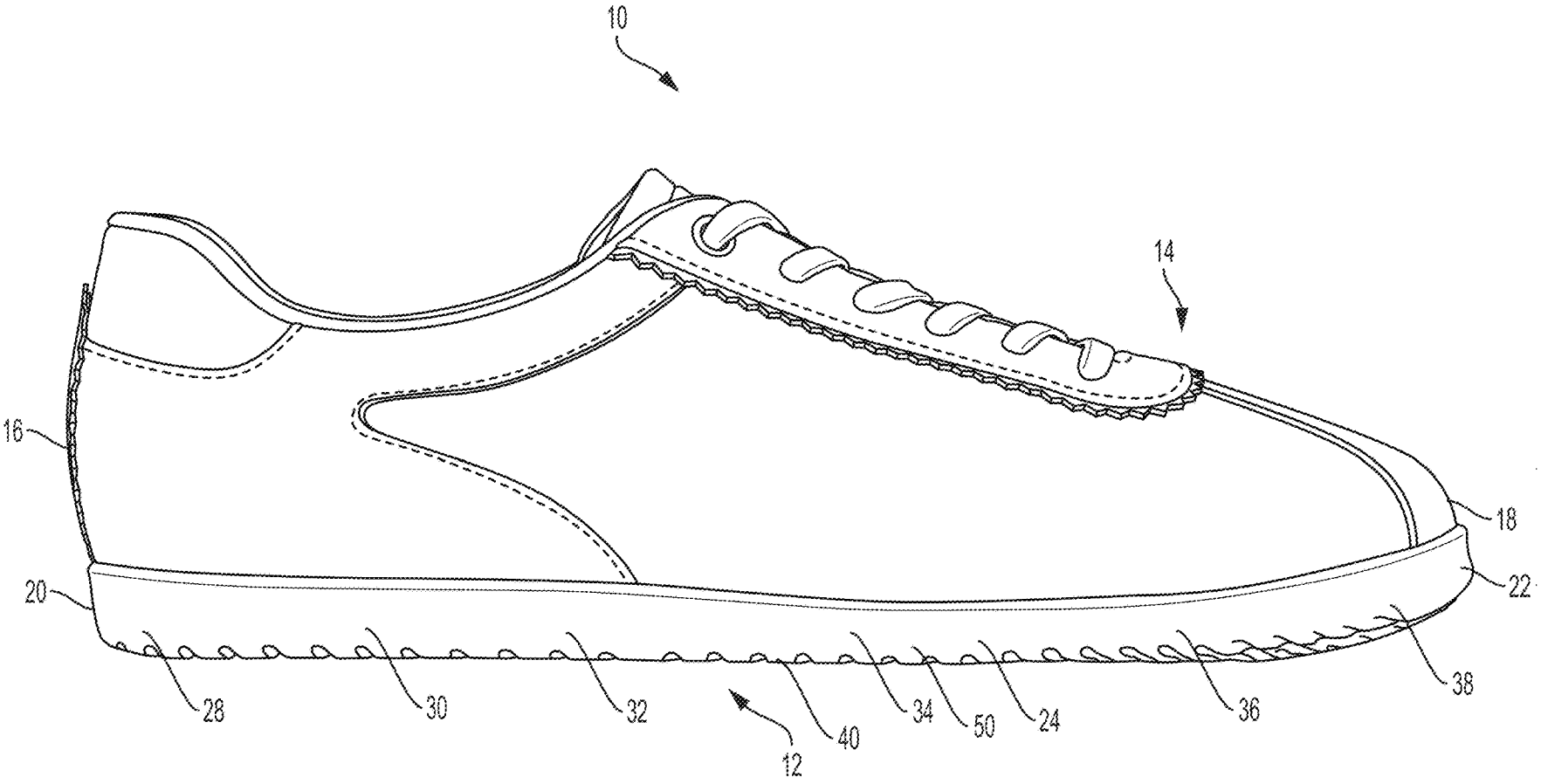
FIG. 2 is a lateral view of the shoe shown in FIG. 1.
Figure 3:
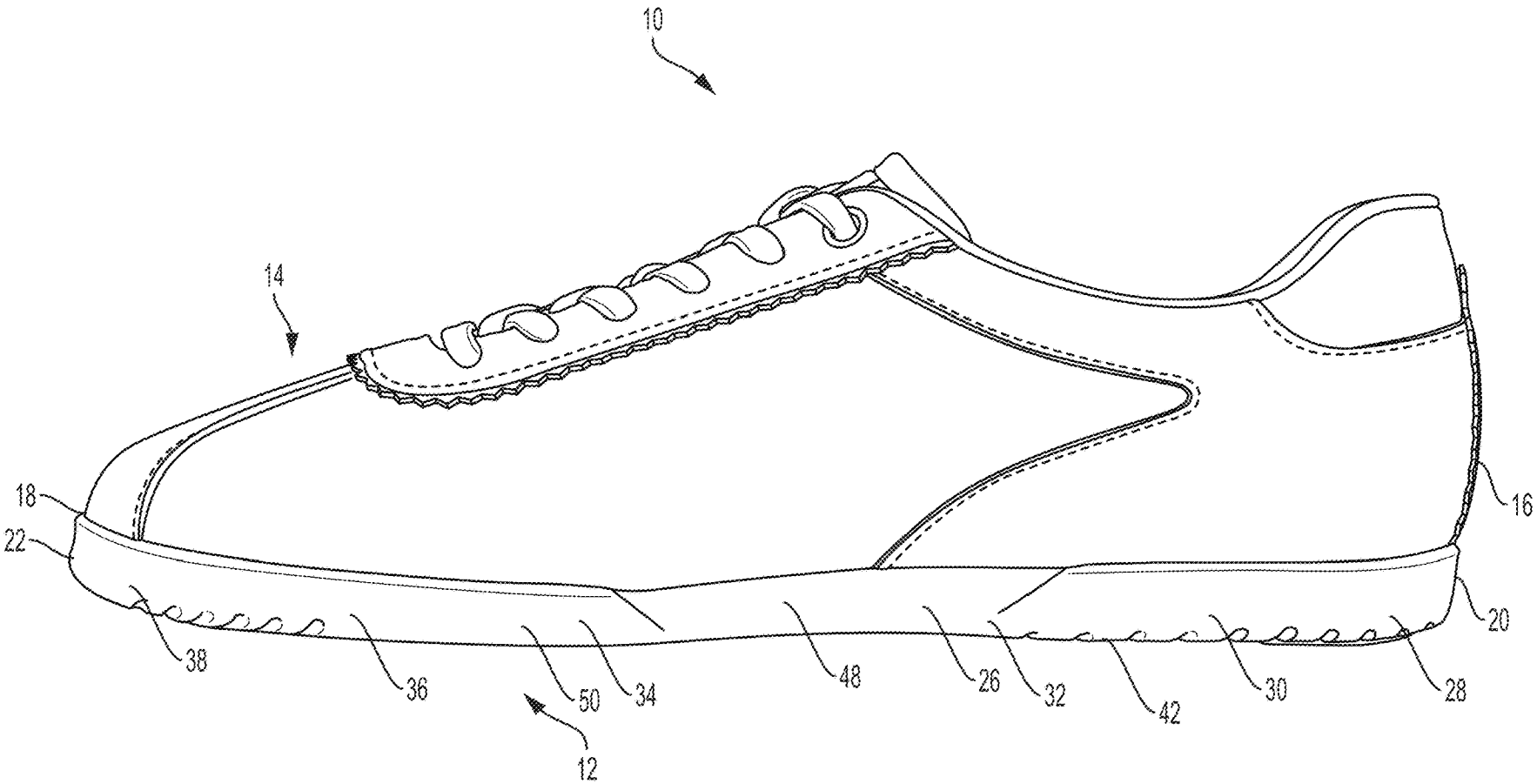
FIG. 3 is a medial view of the shoe shown in FIG. 1.

Reference numerals in the written specification and in the drawing figures indicate corresponding items.

DETAILED DESCRIPTION

An embodiment of a shoe in accordance with the present disclosure is indicated by reference numeral 10. The shoe 10 includes a sole, generally indicated at 12, and an upper, generally indicated at 14. The sole 12 is secured to the upper 14. For example, and without limitation, the upper 14 is stitched, glued, or otherwise suitably secured to the sole 12. The shoe 10 extends forward from a heel end 16 to a toe end 18.

The sole 12 extends longitudinally from a sole heel end 20 to a sole toe end 22 and extends transversely from a sole lateral edge 24 to a sole medial edge 26. The sole includes a heel end region 28, a heel region 30, a midfoot region 32, a ball region 34, a toe region 36, a toe end region 38, a lateral edge region 40, and a medial edge region 42. The heel end region 28 extends longitudinally from the sole heel end 20 to the heel region 30. The heel region 30 extends longitudinally from the sole heel end region 28 to the midfoot region 32. The midfoot region 32 extends longitudinally from the heel region 30 to the ball region 34, and the midfoot region has a lateral midfoot region 44 and a medial midfoot region 46. The lateral midfoot region 44 extends transversely from the lateral edge 24 to the medial midfoot region 46, and the medial midfoot region 46 extends transversely from the medial edge 26 to the lateral midfoot region 44. The ball region 34 of the sole extends longitudinally from the midfoot region 32 to the toe region 36. The toe region 36 extends longitudinally from the ball region 34 to the toe end region 38. The toe end region 38 extends longitudinally from the toe region 36 to the sole toe end 22. The lateral edge region 40 extends from the lateral edge 24 toward the medial edge 26. The medial edge region 42 extends from the medial edge 26 toward the lateral edge 24.

The sole 12 includes a sole member 48 and a spring element 50. The spring element 50 is coupled to the sole member 48. For example, and without limitation, the spring element 50 is coupled to the sole member 48 using adhesive, stitching, a fusing heat treatment, or other suitable technique. The sole member has a footbed surface 52, a bottom surface 54 opposite the footbed surface 52, a heel side surface 56, a toe side surface 58, a medial side surface 60, and a lateral side surface 64. The sole member 48 extends longitudinally from the heel end region 28 to the toe end region 38. The sole member 48 extends longitudinally from the lateral edge region 40 to the medial edge region 42. The spring element 50 is in contact with the toe side surface of the sole member 58, the lateral side surface of the sole member 62, the heel side surface of the sole member 56, and a portion of the medial side surface 60 of the sole member 48. The spring element 50 is adapted and configured to support the sole member 48 by resisting deflection due to one or more of lateral deformation of the sole member 48 and longitudinal deformation of the sole member 48.

For example, and without limitation, the spring element 50 is stiffer material or more resilient material than the sole member 48. The sole member 48 may be made from, for example, a foam such as ethylene-vinyl acetate. The spring element 50 may be made from, for example, a polymer such as thermoplastic polyurethane. The spring element 50 surrounds at least a portion of the sole member 48 such that, when a user is wearing the shoe 10 and steps down, deformation of the foam sole member 48 is resisted.

In some embodiments, the spring element 50 is preloaded such that the spring element 50 is in a deformed state even when the shoe 10 is not being worn. For example, and without limitation, the spring element 50 must be deformed with a force in order to place the spring element 50 around the sole member 48 during construction of the shoe 10. In other embodiments, the spring element 50 is in an at rest state when the shoe is not being worn.

The spring element 50 is in contact with the bottom surface 54 of the sole member 48 in the toe end region 38, the lateral edge region 40, the heel end region 28, and at least a portion of the medial edge region 42. For example, the spring element 50 may be in contact with the bottom surface 54 of the sole member 48 throughout the toe end region 38, throughout the lateral edge region 40, throughout the heel end region 28, and throughout the medial edge region 42 as shown in FIGS. 5-13.

The spring element 50 is also in contact with the sole member 48 throughout the toe side surface 58 of the sole member, the lateral side surface 62 of the sole member, the heel side surface 56 of the sole member, and a portion of the medial side surface 60 of the sole member. A portion of the spring element 50 that is in contact with the medial side surface 60 of the sole member extends upwardly from the bottom surface 54 of the sole member to a lesser extent than portions of the spring element 50 in contact with the toe side surface 58 of the sole member, the lateral side surface 62 of the sole member, and the heel side surface 56 of the sole member.

Figure 4:
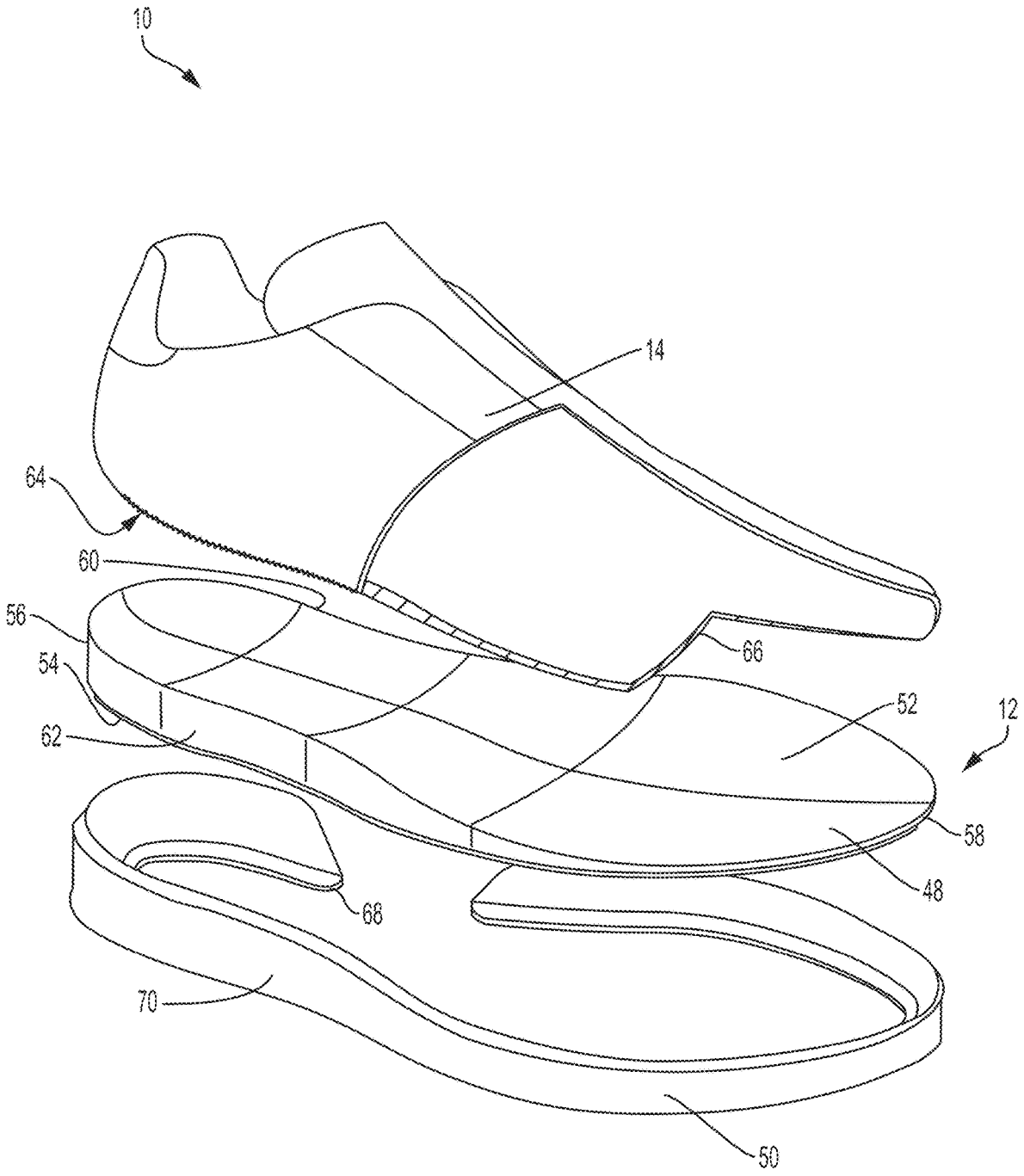
FIG. 4 is an exploded view of a shoe having a sole member and a spring element.

In some embodiments, the spring element 50 is not in contact with the medial side surface 60 of the sole member in at least a portion of the sole medial midfoot region 46 (e.g., as shown in FIG. 4). In some embodiments the spring element 50 is not in contact with the bottom surface 54 of the sole member 48 in at least a portion of the medial edge region 42 (e.g., as shown in FIG. 4).

Figure 5:
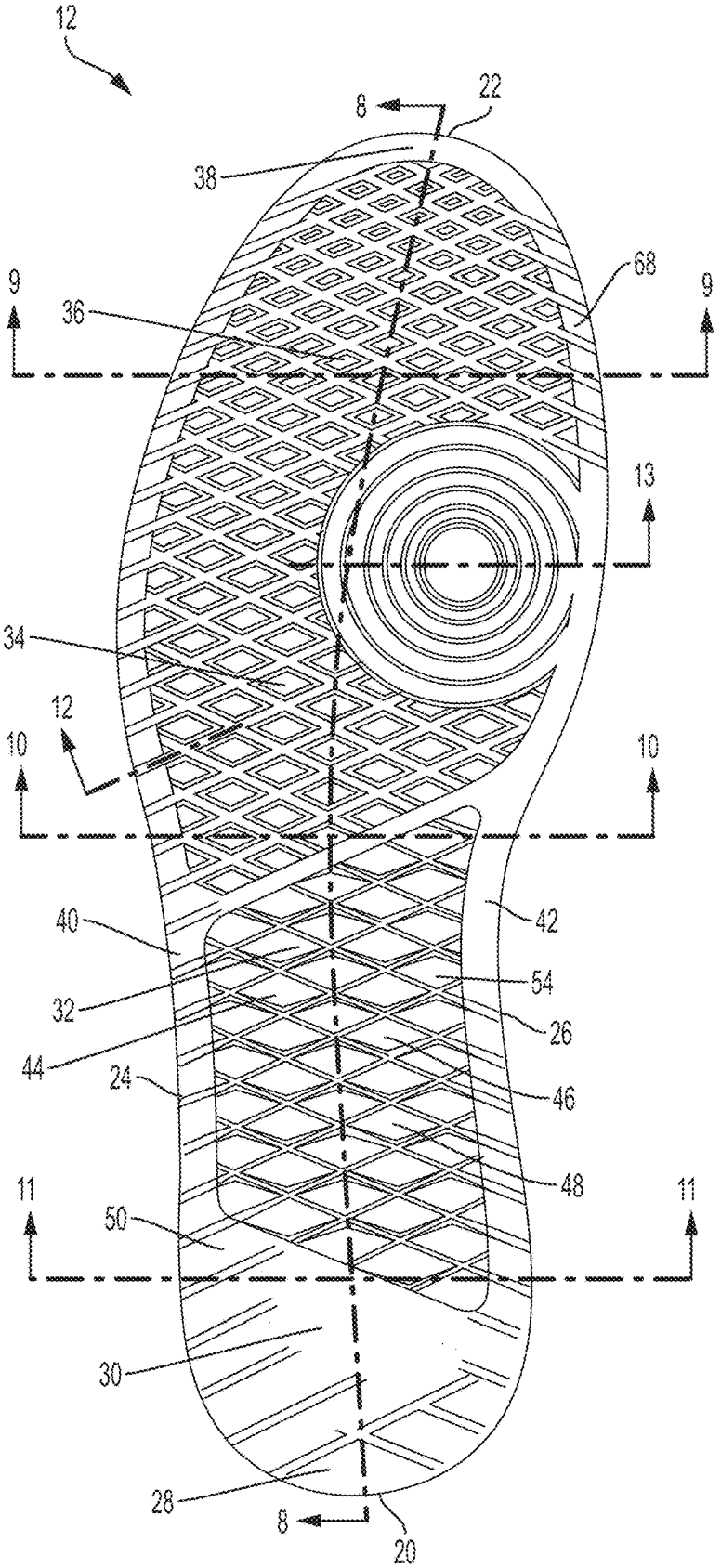
FIG. 5 is a bottom view of the shoe shown in FIG. 1.
Figure 6:
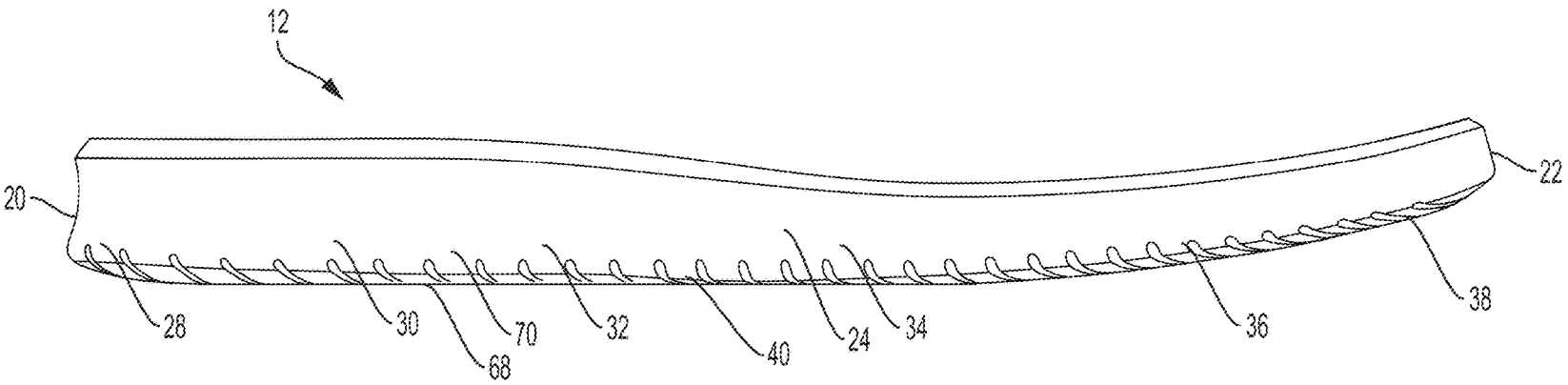
FIG. 6 is lateral view of the sole member and the spring element of the shoe shown in FIG. 1.

The spring element 50 is in contact with the bottom surface 54 of the sole member 48 in one or more of the toe region 36 and the heel region 30. In some embodiments, the spring element 50 is in contact with the bottom surface 54 of the sole member 48 in two or more of the toe region 36, the ball region 34, the midfoot region 32, and the heel region 30. For example, the spring element 50 is in contact with the toe region 36, the ball region 34, and the heel region 30 as depicted in FIG. 5.

In some embodiments, the spring element 50 is not in contact with the bottom surface 54 of the sole member 48 in at least one of the toe region 36, the ball region 34, the midfoot region 32, and the heel region 30. For example, the spring element 50 is not in contact with the bottom surface 54 in the midfoot region 32 as depicted in FIG. 5 (note that the spring element 50 is in contact with the lateral edge region 40 and the medial edge region 42 near the midfoot, region 32).

As previously discussed, the sole member 48 and the spring element 50 are constructed of different materials. In one embodiment, the sole member 48 is constructed of a first material, and the spring element 50 is constructed of a second material. The second material has more rigidity than the first material. The second material may have a higher Young's modulus than the first material.

The upper 14 of the shoe 10 has a Sacchetto construction. For example, and without limitation, stitching 64 on the upper 14 is limited to a bottom portion of the upper 14. The shoe 10 further includes a foam inlay 66. The foam inlay 66 is incorporated within the upper 14 (e.g., in the bottom of the upper 14). The upper 14 is secured to the footbed surface 52 of the sole member 48 such that the foam inlay 66 is positioned above the footbed surface 52 and is coextensive with at least a portion of the sole member 48.

Figure 7:
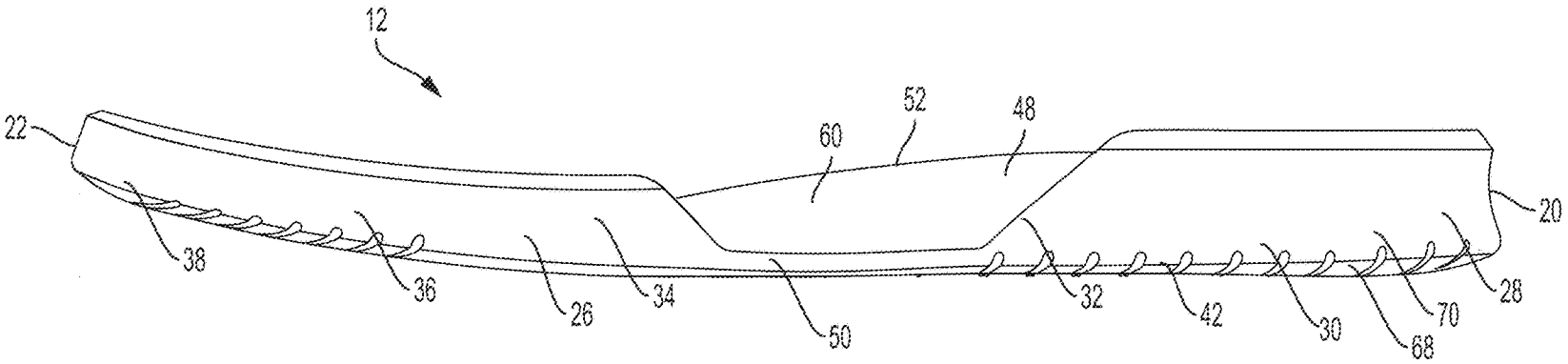
FIG. 7 is a medial view of the sole member and the spring element of the shoe shown in FIG. 1.
Figure 8:
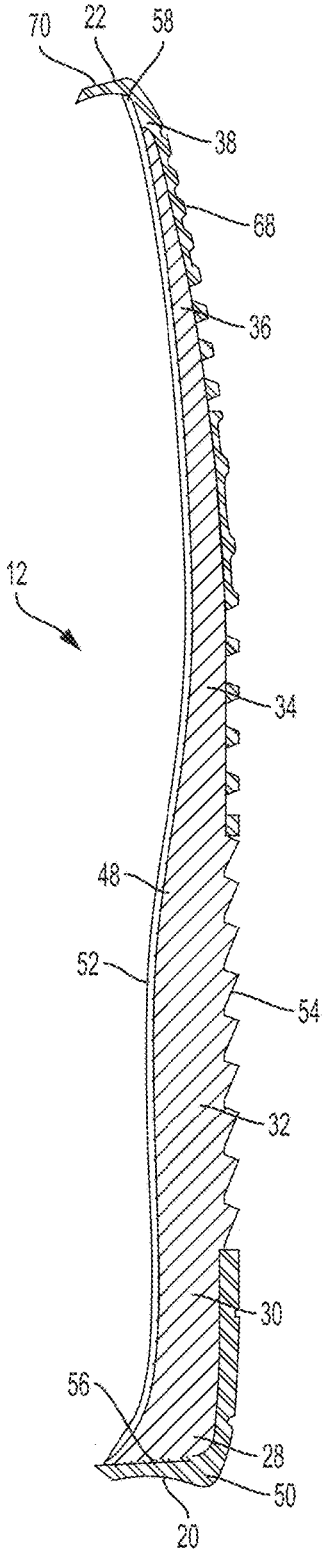
FIG. 8 is a cross-sectional view taken along the line 8-8 of the sole member and the spring element shown in FIG. 5.
Figure 9:
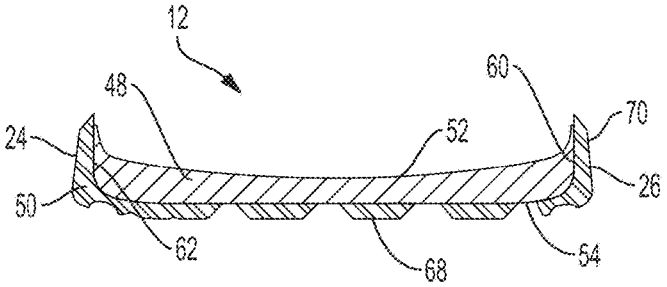
FIG. 9 is a cross-sectional view taken along the line 9-9 of the sole member and the spring element shown in FIG. 5.
Figure 10:
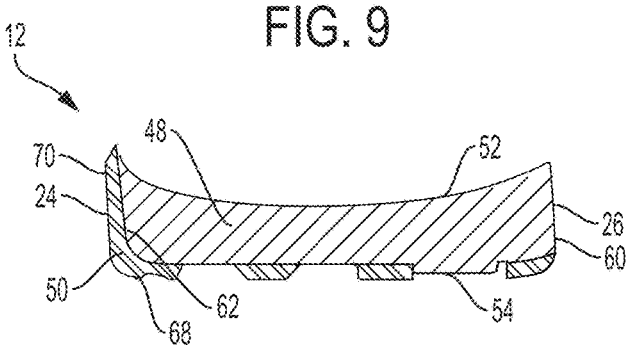
FIG. 10 is a cross-sectional view taken along the line 10-10 of the sole member and the spring element shown in FIG. 5.
Figure 11:
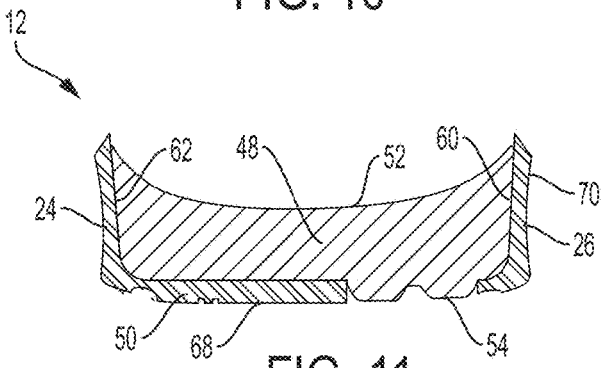
FIG. 11 is a cross-sectional view taken along the line 11-11 of the sole member and the spring element shown in FIG. 5.
Figure 12:
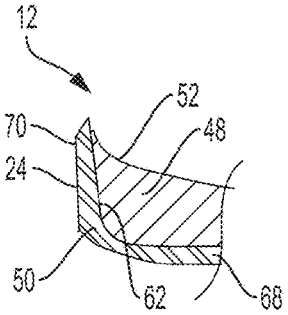
FIG. 12 is a cross-sectional view taken along the line 12 of the sole member and the spring element shown in FIG. 5.
Figure 13:
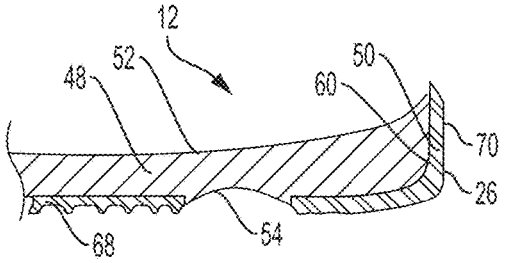
FIG. 13 is a cross-sectional view taken along the line 13 of the sole member and the spring element shown in FIG. 5.

To contact the regions as previously described, the spring element 50 has a ground contacting portion 68 and a side wall portion 70. The side wall portion 70 extends upwardly from the ground contacting portion 68. The side wall portion 70 of the spring element 50 overlaps at least a portion of the sole member toe side surface 58, a portion of the sole member lateral side surface 62, a portion of the sole member heel side surface 56, and a portion of the sole member medial side surface 60. The side wall portion 70 of the spring element 50 does not overlap at least a portion of the sole member medial side surface 60 in the medial midfoot region 46 (e.g., as shown in FIG. 7). The ground contacting portion 68 of the spring element 50 overlaps at least a portion of the bottom surface 54 of the sole member 48.

In some embodiments, the ground contacting portion 68 of the spring element 50 does not overlap the bottom surface 54 of the sole member 48 in the medial midfoot region 46 of the sole, and the side wall portion 70 of the spring element 50 does not overlap the sole member medial side surface 60 at all in at least a portion of the medial midfoot region 46 (e.g., as shown in FIG. 5).

In some embodiments, the ground contacting portion 68 of the spring element 50 overlaps the bottom surface 54 of the sole member 48 in the toe end region 38, lateral edge region 40, heel end region 30, and overlaps the sole member 48 in the medial edge region 42 except in the medial midfoot region 46 of the sole.

In some embodiments, the ground contacting portion 68 of the spring element 50 overlaps the bottom surface 54 of the sole member 48 in the toe region 36 and the heel region 30 (e.g., as shown in FIG. 5).

In view of the foregoing, it should be appreciated that the shoe of the disclosure has several advantages over the prior art.

As various modifications could be made in the constructions and methods herein described and illustrated without departing from the scope of the disclosure, it is intended that all matter contained in the foregoing description or shown in the accompanying drawings shall be interpreted as illustrative rather than limiting. For example, the wedge shoe may be any type of wedge shoe, such as a wedge sandal, a wedge pump, an open-toe wedge, a platform wedge, etc. Thus, the breadth and scope of the present disclosure should not be limited by any of the above-described exemplary embodiments, but should be defined only in accordance with the following claims appended hereto and their equivalents It should also be understood that when introducing elements in the present disclosure in the claims or in the above description of exemplary embodiments of the disclosure, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A shoe comprising:

an upper;

a sole coupled to the upper, the sole extending longitudinally from a sole heel end to a sole toe end and extending transversely from a sole lateral edge to a sole medial edge, the sole including a heel end region, a heel region, a midfoot region, a ball region, a toe region, a toe end region, a lateral edge region, and a medial edge region, the heel end region extending longitudinally from the sole heel end to the heel region, the heel region extending longitudinally from the sole heel end region to the midfoot region, the midfoot region extending longitudinally from the heel region to the ball region and having a lateral midfoot region and a medial midfoot region, the lateral midfoot region extending transversely from the lateral edge to the medial midfoot region, the medial midfoot region extending transversely from the medial edge to the lateral midfoot region, the ball region of the sole extending longitudinally from the midfoot region to the toe region, the toe region extending longitudinally from the ball region to the toe end region, the toe end region extending longitudinally from the toe region to the sole toe end, the lateral edge region extending from the lateral edge toward the medial edge, and the medial edge region extending from the medial edge toward the lateral edge, the sole comprising a sole member and a spring element, the sole member having a footbed surface, a bottom surface opposite the footbed surface, a heel side surface, a toe side surface, a medial side surface, and a lateral side surface, the sole member extending longitudinally from the heel end region to the toe end region, the sole member extending longitudinally from the lateral edge region to the medial edge region, the spring element being in contact with the toe side surface of the sole member, the lateral side surface of the sole member, the heel side surface of the sole member, and a portion of the medial side surface of the sole member, wherein the spring element is adapted and configured to support the sole member by resisting deflection due to one or more of lateral deformation of the sole member and longitudinal deformation of the sole member, wherein the spring element is pre-loaded such that the spring element is in a deformed state even when the shoe is not being worn.

2. A shoe in accordance with claim 1 wherein the spring element is in contact with the bottom surface of the sole member in the toe end region, the lateral edge region, the heel end region, and at least a portion of the medial edge region.

3. A shoe in accordance with claim 1 wherein the spring element is in contact with the bottom surface of the sole member throughout the toe end region, the lateral edge region, the heel end region, and the medial edge region.

4. A shoe in accordance with claim 3 wherein the spring element being in contact with the sole member throughout the toe side surface of the sole member, the lateral side surface of the sole member, the heel side surface of the sole member, and the portion of the medial side surface of the sole member, a portion of the spring element in contact with the medial side surface of the sole member extending upwardly from the bottom surface of the sole member to a lesser extent than portions of the spring element in contact with the toe side surface of the sole member, the lateral side surface of the sole member, and the heel side surface of the sole member.

5. A shoe in accordance with claim 1, the spring element not in contact with the medial side surface of the sole member in at least a portion of the sole medial midfoot region.

6. A shoe in accordance with claim 5 wherein the spring element is not in contact with the bottom surface of the sole member in at least a portion of the medial edge region.

7. A shoe in accordance with claim 1 wherein the spring element is in contact with the bottom surface of the sole member in one or more of the toe region and the heel region.

8. A shoe in accordance with claim 1 wherein the spring element is in contact with the bottom surface of the sole member in two or more of the toe region, the ball region, the midfoot region, and the heel region.

9. A shoe in accordance with claim 5 wherein the spring element is not in contact with the bottom surface of the sole member in at least one of the toe region, the ball region, the midfoot region, and the heel region.

10. A shoe in accordance with claim 1 wherein the sole member is constructed of a first material, and wherein the spring element is constructed of a second material, the second material having more rigidity than the first material.

11. A shoe in accordance with claim 1 wherein the spring element is constructed of a first material and the sole member is constructed of a second material, the first material having a higher Young's modulus than the second material.

12. A shoe in accordance with claim 1, the upper having a Sacchetto construction, and the shoe further comprising a foam inlay, the foam inlay being of one piece with the upper, the upper being secured to the footbed surface of the sole member such that the foam inlay is positioned above the footbed surface and is coextensive with at least a portion of the sole member.

13. A shoe comprising;

an upper;

a sole coupled to the upper, the sole extending longitudinally from a sole heel end to a sole toe end and extending transversely from a sole lateral edge to a sole medial edge, the sole including a heel end region, a heel region, a midfoot region, a ball region, a toe region, a toe end region, a lateral edge region, and a medial edge region, the heel end region extending longitudinally from the sole heel end to the heel region, the heel region extending longitudinally from the sole heel end region to the midfoot region, the midfoot region extending longitudinally from the heel region to the ball region and having a lateral midfoot region and a medial midfoot region, the lateral midfoot region extending transversely from the lateral edge to the medial midfoot region, the medial midfoot region extending transversely from the medial edge to the lateral midfoot region, the ball region of the sole extending longitudinally from the midfoot region to the toe region, the toe region extending longitudinally from the ball region to the toe end region, the toe end region extending longitudinally from the toe region to the sole toe end, the lateral edge region extending from the lateral edge toward the medial edge, and the medial edge region extending from the medial edge toward the lateral edge, the sole comprising a sole member and a spring element, the sole member having a footbed surface, a bottom surface opposite the footbed surface, a heel side surface, a toe side surface, a medial side surface, and a lateral side surface, the sole member extending longitudinally from the heel end region to the toe end region, the sole member extending longitudinally from the lateral edge region to the medial edge region, the spring element having a ground contacting portion and a side wall portion, the side wall portion extending upwardly from the ground contacting portion, the side wall portion of the spring element overlapping at least a portion of the sole member toe side surface, a portion of the sole member lateral side surface, a portion of the sole member heel side surface, and a portion of the sole member medial side surface, at least a portion of the sole in the medial midfoot region being devoid of the spring element, the portion of the sole comprising a portion of the medial side surface of the sole member extending from the sole member footbed surface to the sole member bottom surface and a portion of the bottom surface of the sole member adjacent the portion of the medial side surface of the sole member.

14. A shoe in accordance with claim 13, the ground contacting portion of the spring element overlapping the bottom surface of the sole member in the toe end region, lateral edge region, heel end region, and overlapping the sole member in the medial edge region except in the medial midfoot region of the sole.

15. A shoe in accordance with claim 13, the ground contacting portion of the spring element overlapping the bottom surface of the sole member in the toe region and the heel region.

16. A shoe in accordance with claim 13 wherein the sole member is constructed of a first material, and wherein the spring element is constructed of a second material, the second material having more rigidity than the first material.

17. A shoe in accordance with claim 11, the upper having a Sacchetto construction, and the shoe further comprising a foam inlay, the foam inlay being formed of one piece with the upper, the upper being secured to the footbed surface of the sole member such that the foam inlay is positioned above the footbed surface.

* * * * *